US011092116B1

(12) United States Patent
Broughton et al.

(10) Patent No.: US 11,092,116 B1
(45) Date of Patent: Aug. 17, 2021

(54) FUEL SYSTEM FOR INTERNAL COMBUSTION ENGINE AND MARINE OUTBOARD ENGINE

(71) Applicant: BRP US INC., Sturtevant, WI (US)

(72) Inventors: George Broughton, Wadsworth, IL (US); Mark C. Noble, Pleasant Prairie, WI (US); Richard McChesney, Waukegan, IL (US); Jeffrey Wasil, Kenosha, WI (US)

(73) Assignee: BRP US INC.

( * ) Notice: Subject to any disclaimer, the term of this patent is extended or adjusted under 35 U.S.C. 154(b) by 0 days.

(21) Appl. No.: 16/176,614

(22) Filed: Oct. 31, 2018

Related U.S. Application Data

(60) Provisional application No. 62/579,784, filed on Oct. 31, 2017.

(51) Int. Cl.
*F02M 25/08* (2006.01)
*F02M 37/00* (2006.01)
*F02B 61/04* (2006.01)

(52) U.S. Cl.
CPC ..... *F02M 25/0872* (2013.01); *F02M 25/089* (2013.01); *F02M 25/0836* (2013.01); *F02B 61/045* (2013.01); *F02M 37/0052* (2013.01)

(58) Field of Classification Search
CPC ..... F02M 25/08; F02M 25/0836; F02M 25/0872; F02M 25/086; F02M 25/089
USPC ..... 123/516–518
See application file for complete search history.

(56) References Cited

U.S. PATENT DOCUMENTS 4,722,708 A 2/1988 Baltz
5,740,784 A * 4/1998 McKinney ..... B60K 15/077 123/509
6,244,915 B1 * 6/2001 Ozawa ..... F02M 35/1233 440/88 R
6,257,208 B1 7/2001 Harvey
6,331,127 B1 * 12/2001 Suzuki ..... F02B 61/045 440/88 R
6,959,696 B2 * 11/2005 Shears ..... F02M 25/08 123/516
7,165,536 B2 * 1/2007 Kirk ..... F02M 25/0809 123/519
7,267,112 B2 * 9/2007 Donahue ..... F02M 35/10222 123/518
2006/0107932 A1 * 5/2006 Shibata ..... F02D 33/006 123/516

(Continued)

*Primary Examiner* — John Kwon
*Assistant Examiner* — Johnny H Hoang
(74) *Attorney, Agent, or Firm* — BCF LLP

(57) ABSTRACT

A fuel system for an engine is provided. A fuel injector of the engine has an injector inlet and an injector outlet. The fuel system includes a fuel vapor separator, a fuel supply conduit, an injector conduit, a fuel return conduit, and a vapor return conduit. A first end of each of the fuel supply, injector and vapor return conduits is fluidly connected to the fuel vapor separator. A first end of the fuel return conduit is fluidly connectable to a fuel tank. A second end of the fuel supply conduit is fluidly connectable to the fuel tank. A second end of the injector conduit is fluidly connectable to the injector inlet. A second end of the fuel return conduit is fluidly connectable to the injector outlet. A second end of the vapor return conduit is fluidly connectable to the fuel tank. A marine outboard engine is also provided.

16 Claims, 7 Drawing Sheets

(56) References Cited

U.S. PATENT DOCUMENTS

| | | | | |
|---|---|---|---|---|
| 2007/0101974 | A1* | 5/2007 | Achor | F02M 37/20 123/516 |
| 2008/0245346 | A1* | 10/2008 | Onishi | F02M 37/0058 123/514 |
| 2009/0071448 | A1* | 3/2009 | Smith | F02M 37/20 123/516 |
| 2009/0107460 | A1* | 4/2009 | Hunt | F02M 61/04 123/445 |
| 2012/0060935 | A1* | 3/2012 | Carter | F17C 3/00 137/14 |
| 2017/0045007 | A1* | 2/2017 | Pursifull | F02M 25/0854 |
| 2018/0298850 | A1* | 10/2018 | Villaire | F02M 25/0872 |

* cited by examiner

FUEL SYSTEM FOR INTERNAL COMBUSTION ENGINE AND MARINE OUTBOARD ENGINE

CROSS-REFERENCE

The present application claims priority to U.S. Provisional patent Application No. 62/579,784, entitled "FUEL SYSTEM FOR INTERNAL COMBUSTION ENGINE AND MARINE OUTBOARD ENGINE", filed Oct. 31, 2017, the entirety of which is incorporated herein by reference.

TECHNICAL FIELD

The present technology relates to fuel systems for internal combustion engines and more particularly to fuel systems for marine outboard engines.

BACKGROUND

A typical gasoline-powered marine outboard engine has an internal combustion engine for propelling the marine outboard engine, the internal combustion engine having at least one cylinder and at least one corresponding fuel injector that injects gasoline into the at least one cylinder for powering the engine.

Gasoline is typically delivered to the fuel injector(s) via a fuel system that has two fuel pumps and a fuel vapor separator. A first fuel pump of the two fuel pumps draws fuel from a fuel tank and supplies it to the fuel vapor separator when fuel in the fuel vapor separator drops below a certain threshold detected by a sensor. Typically, the sensor is a float sensor, but alternate types of sensor, such as electronic level sensors, are possible. The first fuel pump is typically a low cost, low-pressure, low precision, fuel pump. One example of such a fuel pump is a conventionally known pulse pump.

A second fuel pump of the two fuel pumps delivers fuel from the vapor separator to the fuel injector(s) of the internal combustion engine. The second fuel pump is typically a high-pressure pump that has a more complicated construction than the first fuel pump, which provides a higher fuel delivery precision than the first fuel pump. The second fuel pump is therefore typically more expensive than the first fuel pump. The higher-precision fuel delivery of the second fuel pump is used to maintain proper operation of the fuel injector(s). More particularly, the higher-precision fuel delivery of the second fuel pump is used to maintain the flow rate and pressure of the fuel supply at the fuel injector(s) in a range of flow rates and pressures that is required by the fuel injector(s).

Not all the fuel pumped to the injector(s) is consumed by the internal combustion engine. A portion of the fuel pumped to the injector(s) is allowed to flow past and thereby cool the fuel injector(s). In some systems, fuel is returned to the fuel vapor separator from the injector(s) and this returned fuel is typically warmer than fuel delivered to the fuel vapor separator from the fuel tank. Such returned fuel is therefore more volatile than cooler fuel, and may be foamy. Fuel in the fuel vapor separator, and especially the warmer fuel in the fuel vapor separator, produces fuel vapor. Fuel vapor is typically vented from a top part of the fuel vapor separator to the internal combustion engine's air intake, where it is consumed during the internal combustion engine's operation.

One example of a conventional fuel system for a marine outboard engine is taught by U.S. Pat. No. 6,257,208.

Another example of a conventional fuel system for a marine outboard engine is taught by U.S. Pat. No. 4,722,708.

Conventional fuel systems are suitable for their intended purposes. However, in one aspect, conventional fuel systems are relatively expensive because they have two fuel pumps, one of which is typically a high precision fuel pump and therefore expensive.

Therefore, there is a desire to reduce marine outboard engine cost.

SUMMARY

It is an object of the present technology to ameliorate at least some of the inconveniences present in the prior art.

For the purposes of this document, the term "conduit" refers to a notional fluid connection and is defined by at least one physical line and/or other components that define at least one fluid conduit (such as a fuel pump, a fuel filter, a valve, and the like). For example, in some embodiments, a fuel "conduit" that connects points A and B is defined by a single (physical) fuel line connecting the points A and B. As another example, in some embodiments, the fuel "conduit" is defined by two (physical) fuel lines interconnected in series or parallel, and connecting the points A and B. In other examples, the fuel "conduit" could also be defined by more than two (physical) fuel lines interconnected in series, parallel, or a combination of series and parallel, and connecting the points A and B.

In turn, for the purposes of this document, the term "line" refers to a physical line for conveying a fluid, such as gasoline or fuel vapor. One example of a fuel line is a fuel hose. Another example of a fuel line is a plastic tube.

For the purposes of this document, the term "gas" refers to fuel vapor alone, air alone, or a combination of fuel vapor and air. It is to be understood that the gas can also include water vapor and other constituents.

For the purposes of this document, the term "fluid" refers to a gas alone, a liquid (such as gasoline) alone, or a combination of one or more gases and one or more liquids.

According to one aspect of the present technology, there is provided a fuel system for an internal combustion engine, the internal combustion engine being for use with a fuel tank and having a fuel injector, the fuel injector having an injector inlet for receiving a fuel supply and an injector outlet in fluid communication with the injector inlet for recirculating at least some of the fuel supply received by the injector inlet when the internal combustion engine operates.

The fuel system includes a fuel vapor separator, a fuel supply conduit, an injector conduit, a fuel return conduit, and a vapor return conduit. A first end of the fuel supply conduit is fluidly connected to the fuel vapor separator. A second end of the fuel supply conduit is fluidly connectable to the fuel tank for supplying fuel from the fuel tank to the fuel vapor separator. A first end of the injector conduit is fluidly connected to the fuel vapor separator. A second end of the injector conduit is fluidly connectable to the injector inlet for supplying fuel from the fuel vapor separator to the injector inlet. A first end of the fuel return conduit is fluidly connectable to the fuel tank. A second end of the fuel return conduit is fluidly connectable to the injector outlet for returning fuel from the injector outlet to the fuel tank. A first end of the vapor return conduit is fluidly connected to the fuel vapor separator. A second end of the vapor return conduit is fluidly connectable to the fuel tank.

In some embodiments, the fuel system further includes a fuel pump fluidly connected to the fuel supply conduit. The fuel pump is operable to supply fuel from the fuel tank to the fuel vapor separator via the fuel supply conduit when the second end of the fuel supply conduit is fluidly connected to the fuel tank.

In some embodiments, the fuel pump is the only fuel pump of the fuel system.

In some embodiments, the fuel pump is fluidly within the fuel supply conduit.

In some embodiments, the fuel pump is a pulse pump.

In some embodiments, the fuel system includes the fuel tank, the second end of the fuel supply conduit is fluidly connected to the fuel tank, and the fuel tank has a pressure relief valve operable to release fuel vapor pressure in the fuel tank to ambient air when the fuel vapor pressure reaches a first predetermined pressure threshold.

In some embodiments, the fuel system includes a check valve positioned in the vapor return conduit. The check valve prevents fluid flow through the check valve in a fluid direction from the fuel tank toward the fuel vapor separator. The check valve prevents fluid flow through the check valve in a fluid direction from the fuel vapor separator toward the fuel tank when fluid pressure in the vapor return conduit fluidly upstream of the check valve is below a second predetermined pressure threshold. In another aspect, the check valve permits fluid flow through the check valve in the fluid direction from the fuel vapor separator toward the fuel tank when fluid pressure in the vapor return conduit fluidly upstream of the check valve is above the second predetermined pressure threshold.

In some embodiments, the vapor return conduit includes a vapor return line fluidly upstream of the check valve, a terminal opening in one end of the vapor return line defines the first end of the vapor return conduit, and the terminal opening in the one end of the vapor return line is located in the fuel vapor separator.

In some embodiments, the vapor return conduit and the fuel return conduit fluidly overlap at least in part.

In some embodiments, the fuel return conduit includes a fuel return line and the vapor return conduit includes a vapor return line physically connected to the fuel return line.

In some embodiments, the vapor return conduit includes a vapor return line, the fuel supply conduit includes a fuel line, and the vapor return line is located within the fuel line.

In some embodiments, the fuel system includes a fuel filter fluidly positioned in the fuel supply conduit, the vapor return conduit includes a vapor return line, the fuel supply conduit includes a fuel line, and the vapor return line is within the fuel line at least between the fuel filter and the fuel tank.

In some embodiments, the fuel vapor separator includes an elongate body that defines a pressurizable fuel chamber therein, and the fuel chamber is structured to have a column of gas in a top part of the fuel chamber when the fuel system operates.

In some embodiments, a terminal opening at the first end of the fuel supply conduit is within the fuel chamber and is located at a first height measured from a bottom surface of the fuel chamber, a terminal opening at the first end of the injector conduit is within the fuel chamber and is located at a second height measured from the bottom surface of the fuel chamber, a terminal opening at the first end of the vapor return conduit is within the fuel chamber and is located at a third height measured from the bottom surface of the fuel chamber, the second height is smaller than the first height, and the third height is greater than the first height.

According to another aspect of the present technology, there is provided a marine outboard engine. The marine outboard engine includes an internal combustion engine having a crankshaft, a fuel injector, the fuel injector having an injector inlet for receiving a fuel supply and an injector outlet in fluid communication with the injector inlet for recirculating at least some of the fuel supply received by the injector inlet when the internal combustion engine operates.

The marine outboard engine also includes a driveshaft having a first end connected to the crankshaft, and a second end opposite the first end; a transmission connected to the second end of the driveshaft to be driven by the driveshaft; an output shaft having a first end connected to the transmission to be selectively driven by the transmission, and a second end opposite the first end; a rotor connected to the second end of the output shaft to driven by the output shaft for propelling the marine outboard engine; and a fuel vapor separator.

In another aspect, the marine outboard engine also includes a fuel supply conduit, an injector conduit, a fuel return conduit, and a vapor return conduit. A first end of the fuel supply conduit is fluidly connected to the fuel vapor separator. A second end of the fuel supply conduit is fluidly connectable to the fuel tank for supplying fuel from the fuel tank to the fuel vapor separator. A first end of the injector conduit is fluidly connected to the fuel vapor separator.

Also, a second end of the injector conduit is fluidly connected to the injector inlet for supplying fuel from the fuel vapor separator to the injector inlet. A first end of the fuel return conduit is fluidly connectable to the fuel tank. A second end of the fuel return conduit is fluidly connected to the injector outlet for returning fuel from the injector outlet to the fuel tank. A first end of the vapor return conduit is fluidly connected to the fuel vapor separator. A second end of the vapor return conduit is fluidly connectable to the fuel tank.

In some embodiments, the marine outboard engine further includes a fuel pump fluidly connected to the fuel supply conduit to be operable to supply fuel from the fuel tank to the fuel vapor separator via the fuel supply conduit when the second end of the fuel supply conduit is fluidly connected to the fuel tank.

In some embodiments, the fuel pump is the only fuel pump of the marine outboard engine.

In some embodiments, the fuel pump is fluidly within the fuel supply conduit.

In some embodiments, the fuel pump is a pulse pump.

In some embodiments, the marine outboard engine includes the fuel tank, the second end of the fuel supply conduit is fluidly connected to the fuel tank, and the fuel tank has a pressure relief valve operable to release fuel vapor pressure in the fuel tank to ambient air when the fuel vapor pressure reaches a first predetermined pressure threshold.

In some embodiments, the marine outboard engine includes a check valve positioned in the vapor return conduit. The check valve prevents fluid flow through the check valve in a fluid direction from the fuel tank toward the fuel vapor separator. The check valve also prevents fluid flow through the check valve in a fluid direction from the fuel vapor separator toward the fuel tank when fluid pressure in the vapor return conduit fluidly upstream of the check valve is below a second predetermined pressure threshold. The check valve also permits fluid flow through the check valve in the fluid direction from the fuel vapor separator toward the fuel tank when fluid pressure in the vapor return conduit fluidly upstream of the check valve is above the second predetermined pressure threshold.

In some embodiments, the vapor return conduit includes a vapor return line fluidly upstream of the check valve, a terminal opening in one end of the vapor return line defines the first end of the vapor return conduit, and the terminal opening in the one end of the vapor return line is located in the fuel vapor separator.

In some embodiments, the vapor return conduit and the fuel return conduit fluidly overlap at least in part.

In some embodiments, the fuel return conduit includes a fuel return line and the vapor return conduit includes a vapor return line physically connected to the fuel return line.

In some embodiments, the vapor return conduit includes a vapor return line, the fuel supply conduit includes a fuel line, and the vapor return line is located within the fuel line.

In some embodiments, the marine outboard engine includes a fuel filter fluidly positioned in the fuel supply conduit, the vapor return conduit includes a vapor return line, the fuel supply conduit includes a fuel line, and the vapor return line is within the fuel line at least between the fuel filter and the fuel tank.

In some embodiments, the fuel vapor separator includes an elongate body that defines a pressurizable fuel chamber therein, and the fuel chamber is structured to have a column of gas in a top part of the fuel chamber when the internal combustion engine operates.

In some embodiments, a terminal opening at the first end of the fuel supply conduit is within the fuel chamber and is located at a first height measured from a bottom surface of the fuel chamber; a terminal opening at the first end of the injector conduit is within the fuel chamber and is located at a second height measured from the bottom surface of the fuel chamber; a terminal opening at the first end of the vapor return conduit is within the fuel chamber and is located at a third height measured from the bottom surface of the fuel chamber; the second height is smaller than the first height; and the third height is greater than the first height.

In some embodiments, the elongate body extends at least in part parallel to the driveshaft.

In some embodiments, the fuel vapor separator is positioned relative to the internal combustion engine such that when the marine outboard engine is attached to a transom of a watercraft in a body of water and is in an in-use position, at least a part of the fuel vapor separator is submerged in the body of water.

In some embodiments, the elongate body is located below the crankshaft and above the output shaft.

The foregoing examples are non-limiting.

For purposes of this application, terms related to spatial orientation such as forward, rearward, upward, downward, left, and right, should be understood in a frame of reference where the propeller position corresponds to a rear of the marine outboard engine. Terms related to spatial orientation when describing or referring to components or sub-assemblies of the engine separately from the engine should be understood as they would be understood when these components or sub-assemblies are mounted to the engine, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology is described with reference to its use in a marine outboard engine 100 that is used to propel a watercraft. It is contemplated that the present technology could have other uses, including a use in other small engine applications.

To maintain clarity of this description, fuel lines of the marine outboard engine 100 have been omitted from FIGS. 1 to 6. The fuel lines and other components of a fuel system 700 of the marine outboard engine 100 are instead shown schematically in FIG. 7 and are described in more detail later in this document. In the embodiment described in FIGS. 1 to 7, all of the fuel lines are conventionally known marine-grade fuel hoses. It is contemplated that the fuel lines could be any other suitable fuel lines.

Figure 1:
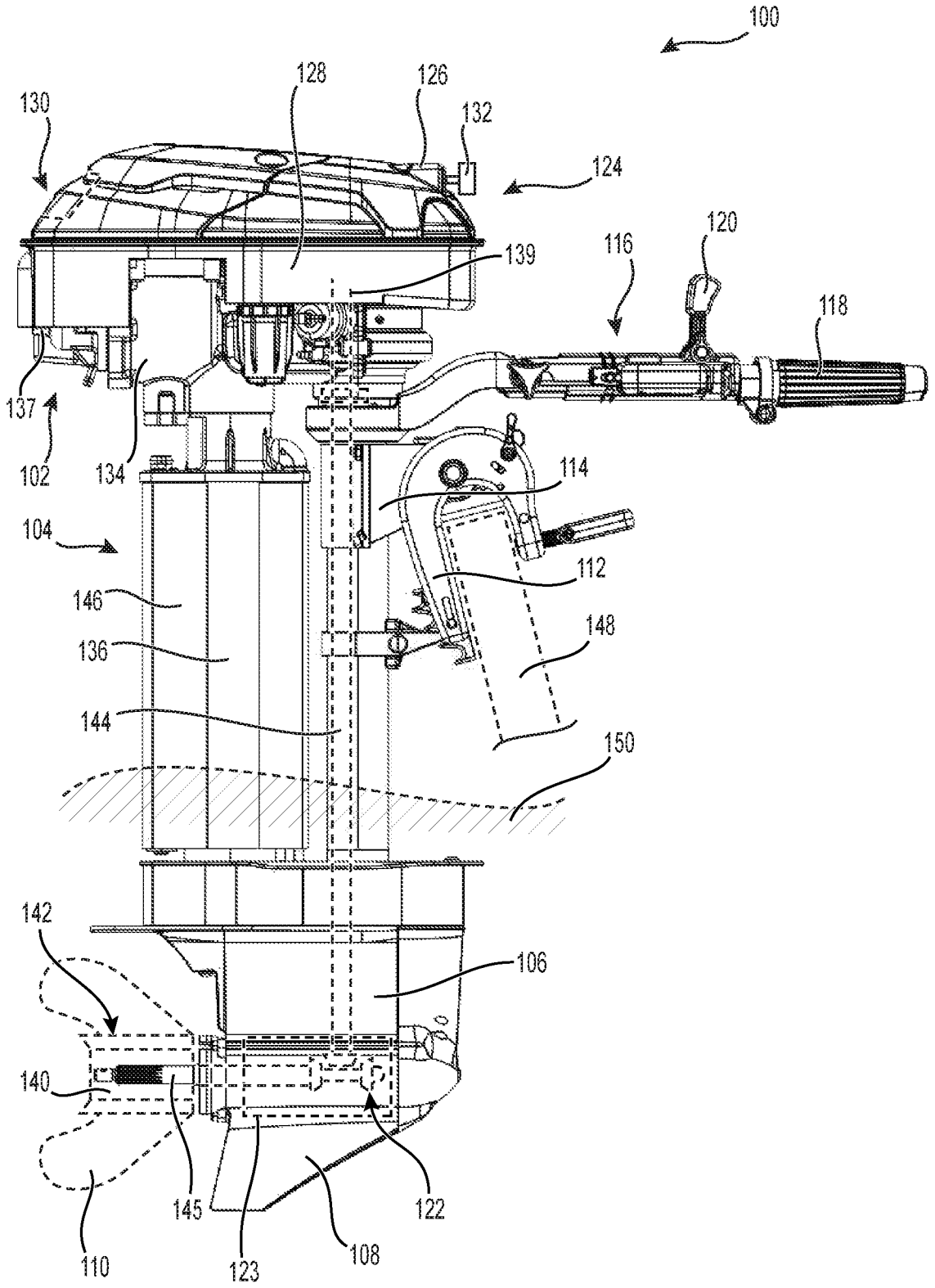
FIG. 1 is a right side elevation view of a marine outboard engine, with fuel lines omitted to maintain clarity.

Now referring to FIG. 1, the marine outboard engine 100 includes an engine assembly 102 for powering the marine outboard engine 100, a mid-section 104, a gearcase 106, a skeg portion 108 and a propeller 110 (shown in phantom lines in FIG. 1).

A stern bracket 112 and a swivel bracket 114 are used to mount the marine outboard engine 100 to a watercraft. The stern bracket 112 is attachable to a watercraft and can take various forms, the details of which are conventionally known. The swivel bracket 114 pivotally connects to the stern bracket 112 to allow for changes in the tilt/trim of the marine outboard engine 100, The mid-section 104 pivotally connects to the swivel bracket 114 to allow for steering of the marine outboard engine 100. It is contemplated that any other mechanism could be used for mounting the marine outboard engine 100 onto a watercraft.

In the implementation shown in FIG. 1, a tiller 116 is connected to the swivel bracket 114 and provides a lever used for manually steering of the marine outboard engine 100. The tiller 116 is rotationally fastened to the swivel bracket 114 such that it can be raised for ease of handling and transportation. The tiller 116 includes a handle 118 in the form of a twist grip used as throttle control as in most conventional small marine outboard engines.

The tiller 116 also includes a shift lever 120 for selecting a forward, neutral or reverse gear of a transmission 122 (housed in a gearcase chamber 123 defined in the gearcase 106, as shown schematically in FIG. 1) of the marine outboard engine 100. It is contemplated that the tiller 116 could be any other tiller. It is also contemplated that the tiller 116 could be omitted and that the marine outboard engine 100 could be steered using a steering wheel connected to a cable, hydraulic, electric or a combination steering system. It is contemplated that the throttle of the marine outboard engine 100 and the transmission 122 could be controlled by one or more levers disposed near the steering wheel.

The marine outboard engine 100 has a cowling 124. The cowling 124 surrounds and protects the engine assembly 102. In the present embodiment, the engine assembly 102 is covered in part by the cowling 124. The cowling 124 includes an upper motor cover assembly 126 and a lower motor cover 128.

The upper motor cover assembly 126 and the lower motor cover 128 are made of molded plastic, but could also be made of metal, composite or the like. The lower motor cover 128 and/or other components of the cowling 124 can be formed as a single piece or as several pieces. For example, the lower motor cover 128 can be formed as two lateral pieces mating along a vertical joint. The lower motor cover 128 is also made, in part, of molded plastic, but could also be made of metal, composites or the like. One suitable composite is a sheet molding compound (SMC) which is typically a fiberglass reinforced sheet molded to shape.

A seal (not shown) is disposed between the upper motor cover assembly 126 and the lower motor cover 128 to form a watertight connection. One or more locking mechanisms (not shown) are provided on at least one of the sides and/or at the front and/or back of the cowling 124 to lock the upper motor cover assembly 126 onto the lower motor cover 128.

The upper motor cover assembly 126 includes an air intake portion 130 (shown schematically in FIG. 1) formed as a recessed portion on the rear of the cowling 124. The air intake portion 130 is configured to allow the entry of air but prevent the entry of water 150 into the interior of the cowling 124 and then into the engine assembly 102. Such a configuration can include a tortuous path for example.

It is contemplated that the air intake portion 130 could be defined elsewhere on the cowling 124. The upper motor cover assembly 126 also defines an aperture (not shown) against which a handle 132 of a manual start assembly (not shown) is received. In the present embodiment, the manual start assembly is a rope-pull start assembly and will not be described herein in detail. It is contemplated that the marine outboard engine 100 could have an electric start assembly (not shown) in addition to or in substitution of the manual start assembly.

The engine assembly 102 includes an internal combustion engine 134. In the present embodiment, the internal combustion engine 134 is a two-stroke, gasoline-powered, direct injected internal combustion engine. It is contemplated that the internal combustion engine 134 could be a four-stroke direct injected internal combustion engine. It is contemplated that the internal combustion engine 134 could use a fuel other than gasoline, such as diesel.

A driveshaft 144 (shown schematically in FIG. 1) of the marine outboard engine 100 is connected to a crankshaft 139 of the internal combustion engine 134. The driveshaft 144 extends downward from the internal combustion engine 134 through the mid-section 104 and into the gearcase 106. The mid-section 104 extends downward from the engine assembly 102 to the gearcase 106 and connects the engine assembly 102 to the gearcase 106.

The propeller 110 is mounted onto a output shaft 145 that is rotationally supported by the gearcase 106 and extends rearward out of the gearcase chamber 123. The transmission 122 selectively couples the driveshaft 144 to the output shaft 145 for transferring power from the internal combustion engine 134 to the propeller 110 to propel the marine outboard engine 100. In the present embodiment, the transmission 122 is a mechanical outboard transmission that is operable by the shift lever 120. It is contemplated that the transmission 122 could be operated by a different mechanism (in which case the marine outboard engine 100 would have the different mechanism instead of the shift lever 120). It is contemplated that the marine outboard engine 100 could have any other transmission.

Figure 2:
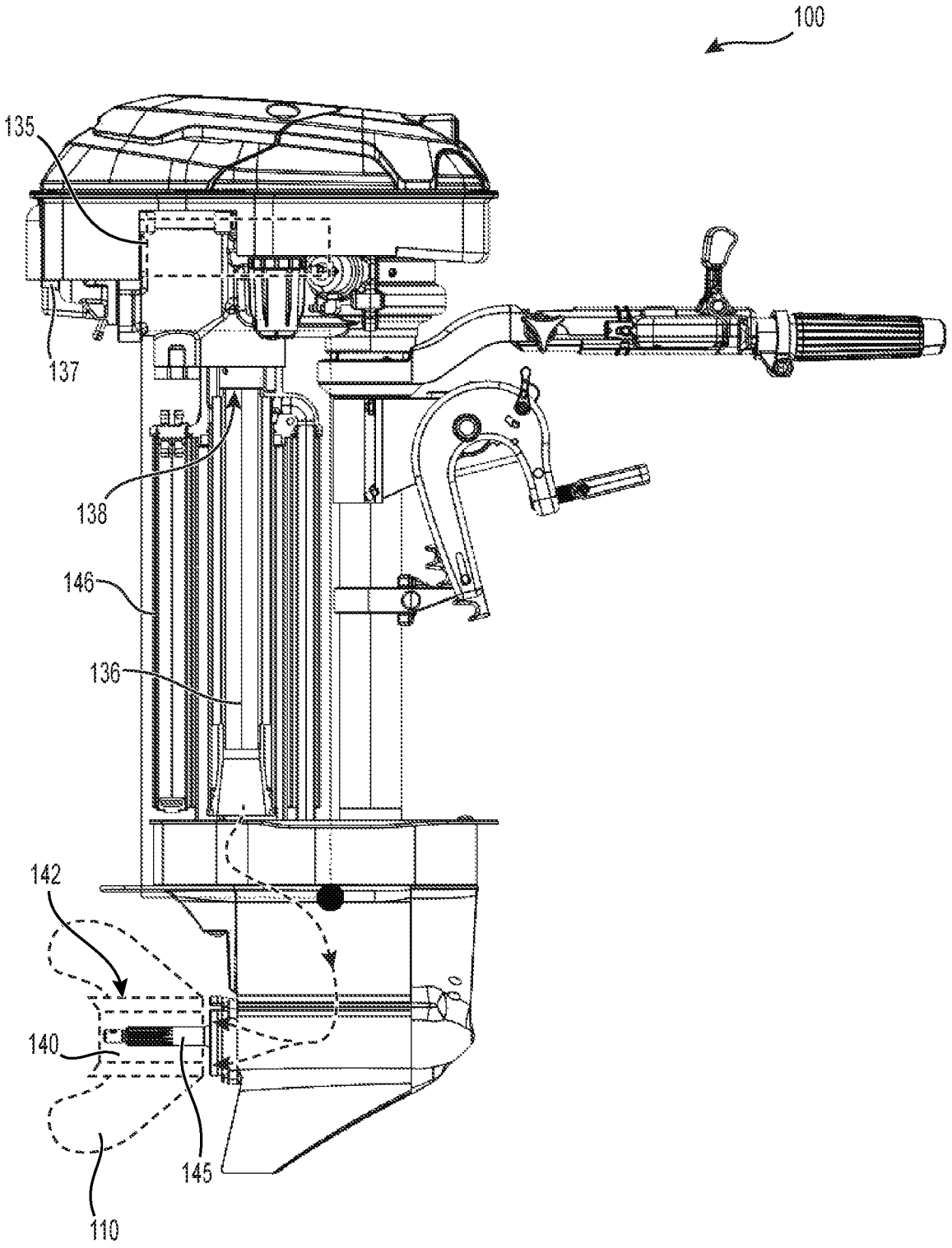
FIG. 2 is a right side elevation, partial sectional view of the marine outboard engine of FIG. 1, taken along a central longitudinal vertical plane passing through the marine outboard engine.

Reference is now made to FIG. 2. When the internal combustion engine 134 operates, it produces exhaust fumes. To this end, an exhaust conduit 136 connects an exhaust port 138 of the internal combustion engine 134 to an exhaust outlet 140 defined in a propeller hub 142 (schematically shown in FIGS. 1 and 2) of the propeller 110.

In the present embodiment, and as schematically shown in FIG. 2, the exhaust conduit 136 extends from the exhaust port 138, downward through the mid-section 104, along the output shaft 145, through the propeller hub 142, and terminates at the exhaust outlet 140. It is contemplated that the exhaust conduit 136 could be routed differently. It is also contemplated that the exhaust outlet 140 could be defined elsewhere in the marine outboard engine 100.

In the present embodiment, the internal combustion engine 134 has a single cylinder 135 (shown schematically in FIG. 2) and a single conventionally known fuel injector 137 that directly injects fuel into the single cylinder 135 of the internal combustion engine 134. It is contemplated that the internal combustion engine 134 could have more than one cylinder 135 and/or more than one fuel injector 137. It is further contemplated that the internal combustion engine 134 could be other than a direct injected engine.

The marine outboard engine 100 includes a fuel vapor separator 146 for, inter alia, deaerating and delivering fuel to the fuel injector 137. Referring now to FIGS. 3 to 6, in the present embodiment, the fuel vapor separator 146 has a metallic wall 300 that defines an elongate body. In the present embodiment, the elongate body is an elongate cylinder 301 having a circular cross-section. It is contemplated that the elongate body could have other shapes.

Figure 5:
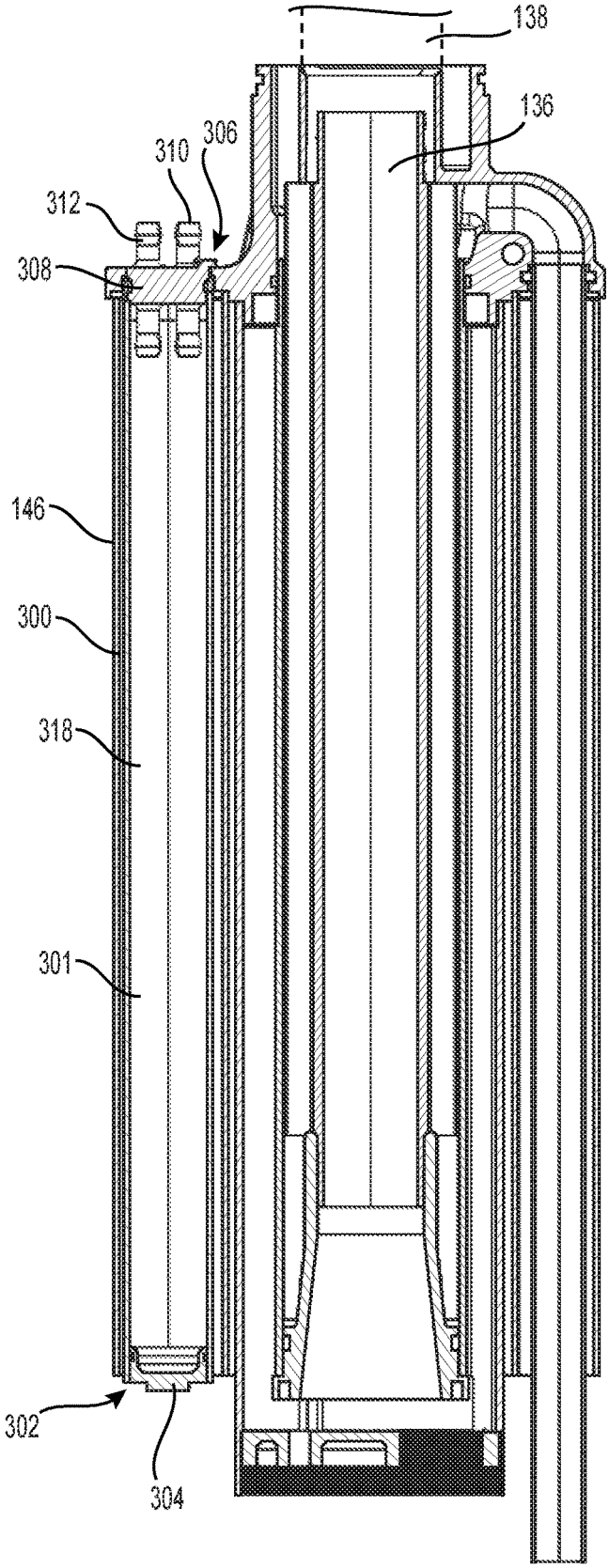
FIG. 5 is a right side elevation, cross-sectional view of a midsection of the marine outboard engine of FIG. 1, taken along a central longitudinal vertical plane passing through the midsection of the marine outboard engine.
Figure 6:
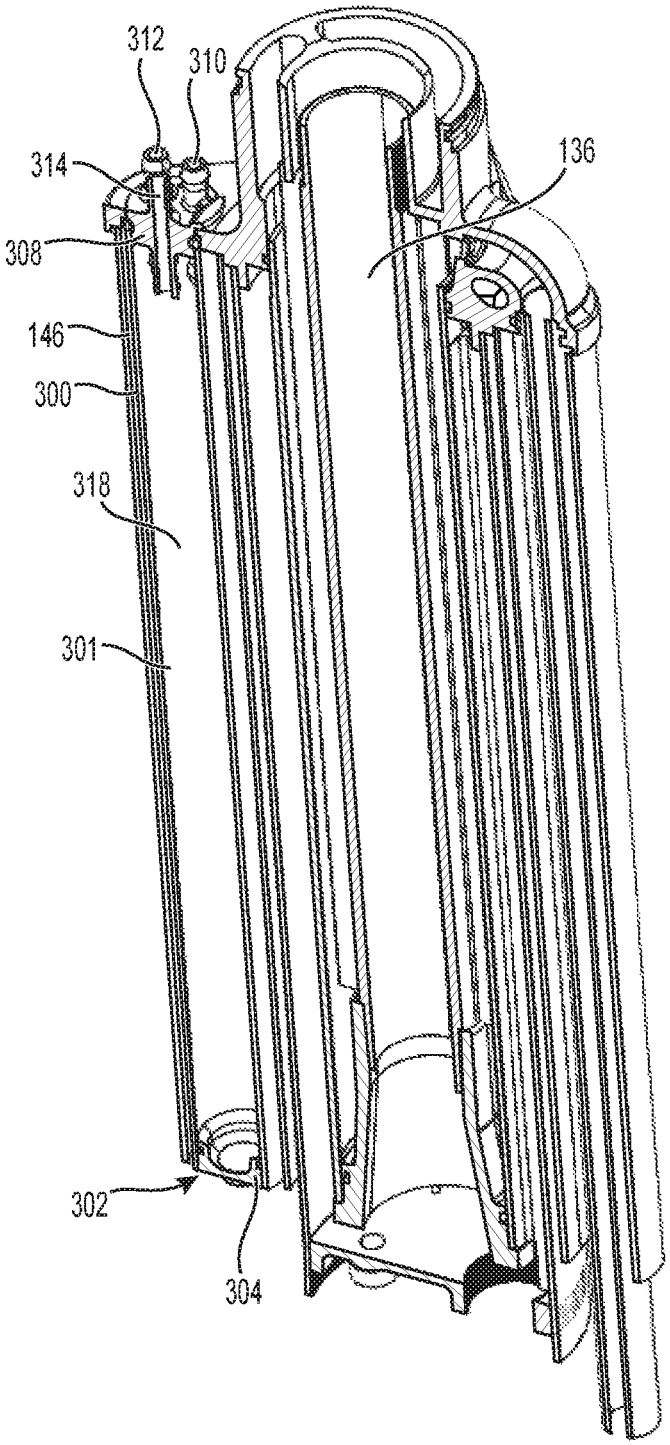
FIG. 6 is a perspective, partial sectional view of the midsection of the marine outboard engine of FIG. 1.

As best shown in FIGS. 5 and 6, the elongate cylinder 301 is mounted alongside the exhaust conduit 136 in the mid-section 104 of the marine outboard engine 100, parallel to the exhaust conduit 136. It is contemplated that the elongate cylinder 301 need not be parallel to the exhaust conduit 136. In another aspect, the elongate cylinder 301 is located below the crankshaft 139 of the internal combustion engine 134 and above the output shaft 145.

Figure 3:
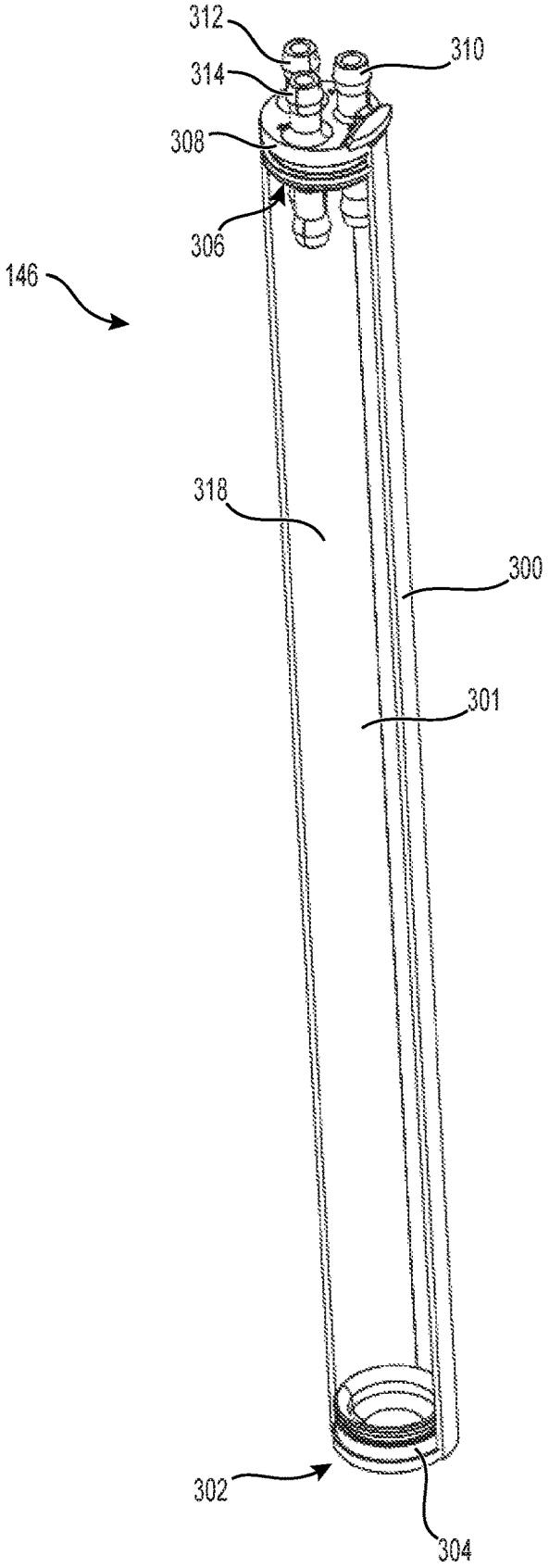
FIG. 3 is a perspective, partial sectional view of a fuel vapor separator of the marine outboard engine of FIG. 1.
Figure 4:
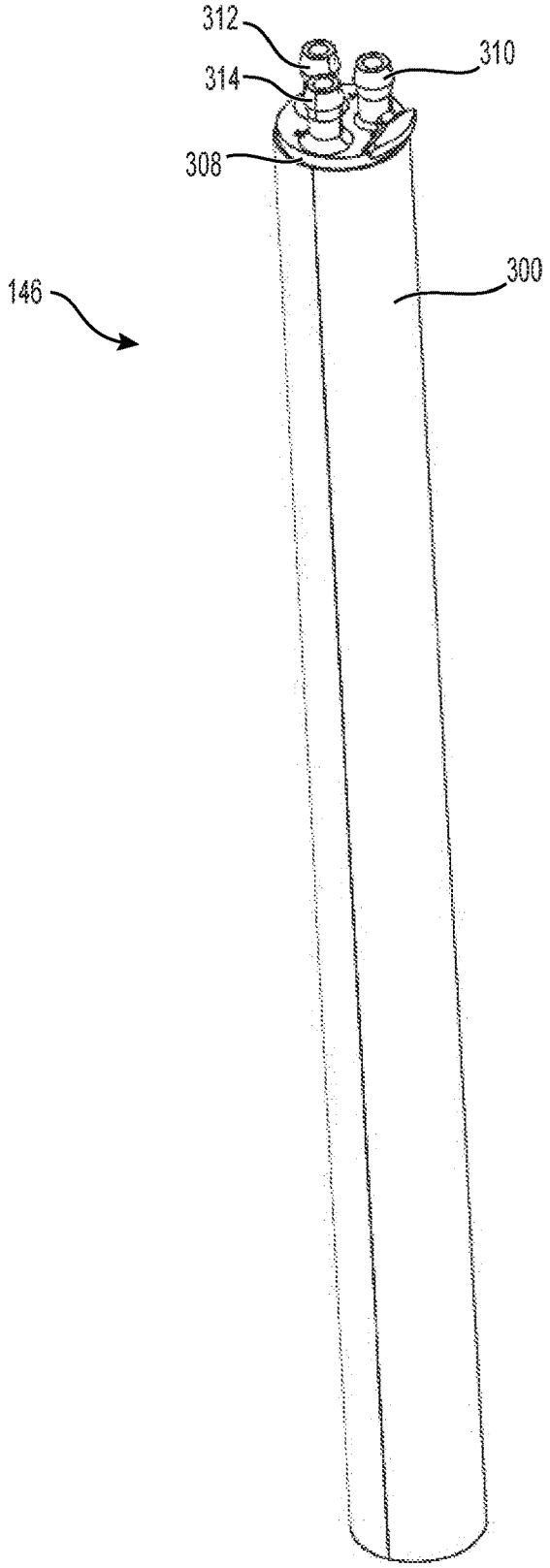
FIG. 4 is a perspective view of the fuel vapor separator of the marine outboard engine of FIG. 1.

As best shown in FIG. 3, the elongate cylinder 301 has an aperture 302 defined its bottom end. The aperture 302 is closed by a plastic plug 304 that is pressed into the aperture 302. A conventionally known seal (not shown) is disposed radially between the plug 304 and a part of the wall 300 that defines the aperture 302. The seal thereby fluidly seals the bottom end of the fuel vapor separator 146. It is contemplated that the bottom end of the elongate cylinder 301 could be fluidly sealed using any other suitable construction of the plug 304 and/or the wall 300. For example, the wall 300 and the plug 304 could be provided with correspondingly threaded surfaces for retaining the plug 304 in the aperture 302, or the plug 304 could be glued, welded or otherwise fixed in place. The wall 300 could also define the elongate cylinder 301 as a cylinder open at its top end and closed at its bottom end.

In another aspect, the elongate cylinder 301 of the fuel vapor separator 146 has another aperture 306 defined its top end. A circumferential groove is defined on an inner side of the wall 300 in the aperture 306. A plastic plug 308 has a circumferential projection and is press fitted into the aperture 306 such that the circumferential projection is mateably received in the circumferential groove in the wall 300 and thereby fluidly seals the interface the wall 300 and the plastic plug 308. It is contemplated that this interface could be fluidly sealed using any other suitable construction, such as those mentioned above. It is also contemplated that the plugs 304, 308 and/or the wall 300 could be made of any other suitable material(s).

The wall 300 of the fuel vapor separator 146 and the plugs 304, 308 define a fuel chamber 318 (inside the elongate body). The (top) plug 308 has three fluid connectors 310, 312, 314 defined therethrough. Each of the fluid connectors 310, 312, 314 fluidly connects to the fuel chamber 318.

Figure 7:
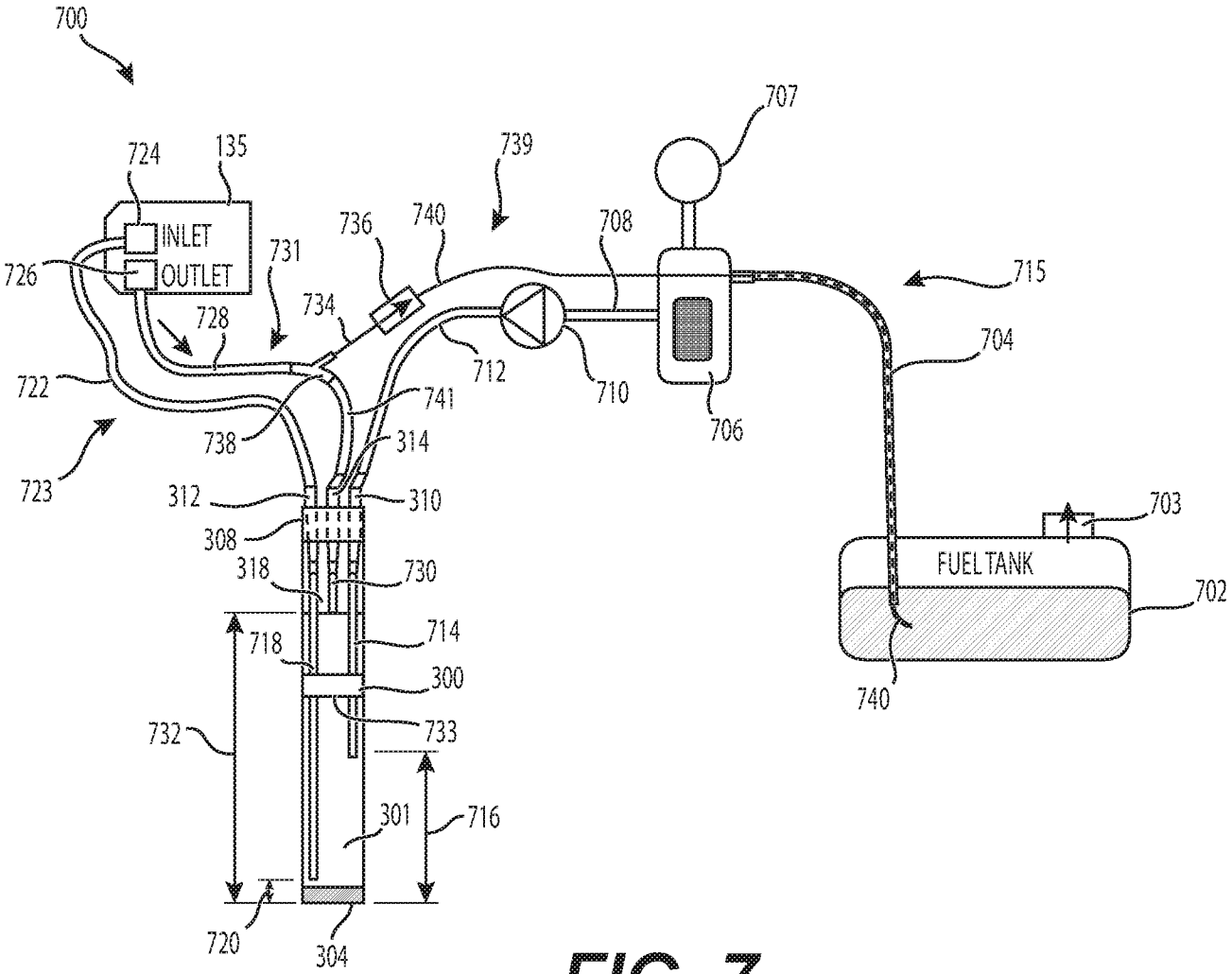
FIG. 7 is a schematic showing a fuel system of the marine outboard engine of FIG. 1, including the fuel lines omitted from FIG. 1.

As schematically shown in FIG. 7, fuel is supplied to the fuel chamber 318 from a fuel tank 702. More particularly, in the present embodiment, a first fuel line 704 fluidly connects the fuel tank 702 to a fuel filter 706. A second fuel line 708 fluidly connects the fuel filter 706 to a fuel pump 710. A third fuel line 712 fluidly connects the fuel pump 710 to a top end of the fluid connector 310. A fourth fuel line 714 is fluidly connected to a bottom end of the fluid connector 310 and extends downward into the fuel chamber 318 to a first height 716 measured from a bottom surface of the fuel chamber 318.

While the internal combustion engine 134 operates, the fuel pump 710 supplies fuel from the fuel tank 702 to the fuel chamber 318 via the first fuel line 704, the fuel filter 706, the second fuel line 708, the third fuel line 712, the fluid connector 310 and the fourth fuel line 714. In other words, the first fuel line 704, the fuel filter 706, the second fuel line 708, the third fuel line 712, the fluid connector 310 and the fourth fuel line 714 define a fuel supply conduit 715. It is contemplated that the fuel supply conduit 715 could be defined by different elements, such as other and/or additional fuel lines.

In the present embodiment, the fuel tank 702 is a conventional marine outboard engine fuel tank that has a fuel vapor pressure relief valve 703 for relieving pressure of fuel vapor in the fuel tank 702. The fuel vapor pressure relief valve 703 opens and thereby fluidly connects the fuel tank 702 to ambient air when pressure of fuel vapor in the fuel tank 702 exceeds 5 pounds-per-square-inch ("psi"). It is contemplated that a different fuel tank and/or a different vapor pressure relief valve 703 could be used.

In the present embodiment, the fuel filter 706 is a conventionally known marine outboard engine fuel filter that has a primer bulb for priming the fuel system 700 of the internal combustion engine 134 to prepare the internal combustion engine 134 for a cold start. It is contemplated that a different fuel filter could be used and/or that the primer bulb could be located elsewhere within the fuel system 700.

In the present embodiment, the fuel pump 710 is a conventionally known pulse pump that is driven by crankcase pressure of the internal combustion engine 134 and generates fifteen psi of pressure. It is contemplated that the fuel pump 710 could be place elsewhere in the fuel system 700. It is also contemplated that the fuel pump 710 could be any other suitable fuel pump and could be selected to provide any other suitable pumping pressure, depending on the particular embodiments of the other components of the fuel system of the marine outboard engine 100. In one example, the fuel pump 710 could be an electric pump positioned within the chamber 318 of the vapor separator 146.

Fuel supplied to the fuel chamber 318 deaerates in the fuel chamber 318, and is supplied from a bottom of the fuel chamber 318 to an injector inlet 724 of the fuel injector 137. To this end, a fifth fuel line 718 is fluidly connected to a bottom end of the fluid connector 312 and extends downward into the fuel chamber 318 to a second height 720 measured from the bottom surface of the fuel chamber 318. A sixth fuel line 722 fluidly connects a top end of the fluid connector 312 to the injector inlet 724.

In the present embodiment, the second height 720 is a lowest point in the fuel chamber 318. This reduces risk of supplying the injector inlet 724 with fuel that contains air bubbles and/or vapor bubbles (which are more likely to be present fuel in an upper half of the fuel chamber 318 than in a lower half of the fuel chamber 318) during normal operation. In some embodiments, the second height 720 could be higher than the lowest point in the fuel chamber 318.

During operation of the internal combustion engine, the fuel pump 710 supplies fuel to the fuel chamber 318 and thereby pressurizes the fuel chamber 318. Fuel from the fuel chamber 318 is, in turn, supplied from the fuel chamber 318 to the injector inlet 724 via the fifth fuel line 718, the fuel connector 312 and the sixth fuel line 722. In other words, the fifth fuel line 718, the fuel connector 312 and the sixth fuel line 722 define an injector conduit 723 that supplies fuel from the fuel chamber 318 to the injector inlet 724. It is contemplated that the injector conduit 723 could be defined by different elements, such as other and/or additional fuel lines.

To prevent or at least reduce short-circuiting of fuel between the fuel supply conduit 715 and the injector conduit 723, the second height 720 and the first height 716 are selected such that a bottom of the injector conduit 723 and a bottom end of the fuel supply conduit 715 (in the fuel chamber 318) are sufficiently far apart from each other (in the present embodiment, in a height direction). More particularly, the spacing is selected to prevent or at least reduce fuel entering the fuel chamber 318 from the fuel supply conduit 715 from short circuiting the fuel vapor separator 146 by flowing directly from the bottom end of the fuel supply conduit 715 to the bottom end of the injector conduit 723.

In another aspect, some of the fuel supplied to the fuel injector 137 is recirculated back to the fuel tank 702. To this end, the fuel injector 137 has an injector outlet 726 in fluid communication with the injector inlet 724 for recirculating some of the fuel supply received by the injector inlet 724, for cooling the fuel injector 137. A seventh fuel line 728 fluidly connects the injector outlet 726 to a top end of a Y-connector 738. An eighth fuel line 741 is fluidly connected to a bottom end of the Y-connector 738 and extends downwards to the fluid connector 314. A ninth fuel line 730 extends downward from the fluid connector 314 into the fuel chamber 318 of the fuel vapor separator 146 to a third height 732 measured from the bottom surface of the fuel chamber 318.

A tenth fuel line 734 fluidly connects the Y-connector 738 to a check valve 736 and an eleventh fuel line 740 fluidly connects the check valve 736 to the fuel tank 702. Fuel recirculated by the fuel injector 137 flows from the injector outlet 726 into the fuel tank 702 via the seventh fuel line 728, the Y-connector 738, the check valve 736 and the eleventh fuel line 740. In other words, the seventh fuel line 728, the Y-connector 738, the check valve 736 and the eleventh fuel line 740 define a fuel return conduit 731 that returns some of the fuel supplied to the injector inlet 724 back to the fuel tank 702. It is contemplated that the fuel return conduit 731 could be defined by different elements, such as other and/or additional fuel lines.

In the present embodiment, about 50% of the fuel supply to the injector inlet 724 is consumed by the internal combustion engine 134 when operating at maximum throttle (also referred to as "wide open throttle"), while the remaining 50% is recirculated back to the fuel tank 702. At minimum throttle (also referred to as "idle"), about 1% of the fuel supply to the injector inlet 724 is consumed and 99% is recirculated back to the fuel tank 702. It is contemplated the proportion between the rate of fuel consumption and the rate of fuel recirculation could be different depending on, for example, each particular embodiment of the internal combustion engine 134 and each particular embodiment of the fuel injector 137.

To help reduce production of fuel vapor within the fuel vapor separator 146, it is positioned relative to the engine assembly 102 such that when the marine outboard engine 100 is attached to a transom 148 (shown schematically in FIG. 1) of a watercraft (not shown) in a body of water 150 and is in an in-use position, at least a part of the fuel vapor separator 146 is submerged in the body of water 150 (as shown in FIG. 1).

The at least partial submergence of the fuel vapor separator 146 in the body of water 150 cools fuel in the fuel chamber 318 when the marine outboard engine 100 is in use. This helps reduce fuel vapor production in the fuel chamber 318.

In another aspect, dining operation of the internal combustion engine 134, fuel fills the fuel chamber 318 to the bottom end of the ninth fuel line 730 and creates a fuel column in the fuel chamber 318, the fuel column having the third height 732. To ensure that the fuel column that will cover the terminal opening (which is in the fourth fuel line 714 at the first height 716) of the fuel supply conduit, the third height 732 is selected to be greater than the first height 716. In some applications, this will reduce splashing of fuel entering the fuel chamber 318 from the fuel supply conduit. In turn, reduced splashing will also reduce fuel vapor production in at least some operating conditions.

Additionally, a conventionally known foam block 733 is disposed inside the fuel chamber 318. The foam block 733 further helps reduce splashing of fuel inside the fuel chamber 318. It is contemplated that in some embodiments, the foam block 733 could be larger or smaller than illustrated in FIG. 7, or omitted entirely.

The fuel vapor produced by fuel in the fuel chamber 318 and pumped into the fuel chamber 318 from the fuel tank 702 accumulates in a column of gas that is trapped in the fuel chamber 318 above the column of fuel in the fuel chamber 318. As more vapor accumulates, it pushes the fuel down, lowering the height of the fuel column and exposing the bottom end of the ninth fuel line 730, which in turn allows vapor to escape through a vapor return conduit 739 formed by the ninth fuel line 730, the fluid connector 310, the eighth fuel line 741, the Y-connector 738, the check valve 736 and the eleventh fuel line 740.

In the present embodiment, the outlet of the Y-connector 738 in fluid communication with the fuel chamber 318 is sized to have a smaller diameter than the inlet of the Y-connector 738. This restriction, which could be positioned in the eighth fuel line 741, the fluid connector 314 or the ninth fuel line 730, is smaller than the diameter of the injector conduit 723 and therefore acts to maintain fluid pressure at the injector inlet 724 and prevents fuel from flowing from the fuel chamber 318 to the injector outlet 726. It is contemplated that a restriction, such as the smaller diameter of the main outlet of the Y-connector 738, would not be required where, for example, the diameter of the seventh fuel line 728 downstream of the Y-connector 738 would have a suitably-reduced diameter.

In the present embodiment, a part of the eleventh fuel line 740 extends through the fuel filter 706 into the fuel line 704, and extends inside the fuel line 704 to the fuel tank 702.

In the present embodiment, and as shown schematically in FIG. 7, a part of the eleventh fuel line 740 extends inside the fuel line 704 through the whole length of the fuel line 704 and exits the fuel line 704 into the fuel tank 702. In some embodiments, the eleventh fuel line 740 extends inside a part of the length of the fuel line 704. In some embodiments, the eleventh fuel line 740 does not pass through the fuel filter 706.

In many jurisdictions, lines used to transport fuel (whether in liquid or vapor form) within a vessel, such as between a fuel tank and an outboard engine, must meet strict regulations and are therefore very expensive. Therefore, in at least some jurisdictions, extension of the eleventh fuel line 740 inside the fuel line 704 allows the part of the eleventh fuel line 740 that is inside the fuel line 704 to be a relatively lower-grade fuel line (and therefore cheaper) than the fuel line 704, while ensuring safety and maintaining compliance with applicable regulations. It is contemplated that all of the eleventh fuel line 740 could be positioned completely outside of the fuel line 704, in which case, in at least some jurisdictions, all of the eleventh fuel line 740 would need to meet the same regulations (if any apply) as the fuel line 704.

In the present embodiment, the check valve 736 is a conventionally known check valve that permits flow of fluid (which could be fuel and/or fuel vapor and/or air) from the fuel chamber 318 toward the fuel tank 702 when pressure of fluid in the tenth fuel line 734 (and therefore also in the vapor return conduit 739 fluidly upstream of the check valve 736) is above a predetermined pressure threshold of the check valve 736.

In the present embodiment, the check valve 736 is selected such that the predetermined pressure threshold is equal to the pressure of the fuel pump 710 (i.e. fifteen psi). Therefore, when pressure of fluid in the tenth fuel line 734 exceeds fifteen psi, the check valve 736 opens and fluid in the tenth fuel line 734 flows through the check valve 736 toward the fuel tank 702. In other words, in the present embodiment, the tenth fuel line 734, the check valve 736, and the eleventh fuel line 740 define the vapor return conduit 739. The vapor return conduit 739 fluidly connects the fuel chamber 318 to the fuel tank 702 when the check valve 736 is open.

By opening at the predetermined pressure threshold, the check valve 736 relieves pressure of fluid in the fuel chamber 318 to the fuel tank 702 via the vapor return conduit 739. In some such cases, the fluid flowing through the check valve 736 is fuel vapor from the fuel chamber 318. In some such cases, the fuel vapor in the fuel chamber 318 rises up through the ninth fuel line 730 and the eighth fuel line 741 to the Y-connector 738. This fuel vapor then flows through the Y-connector 738, the tenth fuel line 734, the check valve 736 and the eleventh fuel line 740 to the fuel tank 702. The fuel vapor can then be vented from the fuel tank 702 to ambient air via the fuel vapor pressure relief valve 703 of the fuel tank 702.

In another aspect, when the pressure of the fluid in the vapor return conduit 739 upstream of the check valve 736 is below the predetermined pressure threshold of the check valve 736, the check valve 736 is closed. When the check valve 736 is closed, the check valve 736 prevents fluid flow through the check valve 736, and therefore prevents fluid flow through the vapor return conduit 739 in a fluid direction from the fuel chamber 318 toward the fuel tank 702.

Also, irrespective of pressure of fluid in the tenth fuel line 734, the check valve 736 prevents fluid flow through the check valve 736 (and therefore also through the vapor return conduit 739) in a fluid direction from the fuel tank 702 toward the fuel chamber 318. In one aspect, this helps ensure that fuel from the fuel tank 702 does not enter the fuel chamber 318 through the vapor return conduit 739, in which case the fuel would bypass the fuel filter 706.

The operation of the check valve 736 helps maintain pressure of fuel and fuel vapor in the fuel chamber 318 at the predetermined pressure threshold of the check valve 736. In another aspect, the operation of the check valve 736 reduces fluid pressure variations in the fuel chamber 318 (and therefore also at the injector inlet 724 and the injector outlet 726, which are fluidly connected to the fuel chamber 318).

More specifically, during some operating conditions, variations in the fluid pressure output (that is, head) of the fuel pump 710 will occur, to a lesser or a greater degree depending on the particular embodiment of the fuel pump 710. Some variations in the fluid pressure output of the fuel pump 710 will cause variations of the level of fuel in the fuel chamber 318 and corresponding compressions and expansions of the column of gas above the fuel in the fuel chamber 318.

The corresponding compressions and expansions of the column of gas will dampen at least some variations in the fluid pressure output of the fuel pump 710, and excessive expansions of the column of gas will be mitigated by being vented by the operation of the check valve 736 (described above). This creates a pressure buffering effect in the fuel chamber 318. As a result, in at least some operating conditions, variations in the pressure of the fuel supply at the injector inlet 724 are smaller in magnitude than variations in the pressure output of the fuel pump 710.

In some cases, this allows the fuel pump 710 to be selected as a fuel pump that has a relatively simpler construction and is relatively less precise in maintaining a given fluid pressure output, while maintaining the fuel supply to the injector inlet 724 within a range of pressures that is suitable for maintaining proper operation of the fuel injector 137. In some cases, such fuel pumps are relatively cheaper than more complicated fuel pumps that are designed to provide a relatively more stable and more precise fluid supply pressure output. In some cases, simpler fuel pumps are more reliable than more complex fuel pumps.

Also, in the present embodiment, the fuel system of the marine outboard engine 100 operates on the single fuel pump 710. In some cases, this reduces manufacturing costs of the marine outboard engine 100. In some cases, this increases reliability of the marine outboard engine 100 (for example, due to the marine outboard engine 100 having a relatively smaller number of components).

Modifications and improvements to the above-described implementations of the present technology may become apparent to those skilled in the art. The foregoing description is intended to be exemplary rather than limiting.

The invention claimed is:

1. A fuel system for an internal combustion engine, the internal combustion engine being for use with a fuel tank and having a fuel injector, the fuel injector having an injector inlet for receiving a fuel supply and an injector outlet in fluid communication with the injector inlet for recirculating at least some of the fuel supply received by the injector inlet when the internal combustion engine operates, the fuel system comprising:

a fuel vapor separator defining a fuel chamber, the fuel chamber being a pressurizable fuel chamber, the fuel vapor separator including an elongate body defining the pressurizable fuel chamber therein, the fuel chamber being structured to have a column of gas in a top part of the fuel chamber when the fuel system operates;

a fuel supply conduit, a first end of the fuel supply conduit being fluidly connected to the fuel chamber, a second end of the fuel supply conduit being fluidly connectable to the fuel tank for supplying fuel from the fuel tank to the fuel chamber, a terminal opening at the first end of the fuel supply conduit being within the fuel chamber and being located at a first height measured from a bottom surface of the fuel chamber;

an injector conduit, a first end of the injector conduit being fluidly connected to the fuel vapor separator, a second end of the injector conduit being fluidly connectable to the injector inlet for supplying fuel from the fuel vapor separator to the injector inlet, a terminal opening at the first end of the injector conduit being within the fuel chamber and being located at a second height measured from the bottom surface of the fuel chamber, the second height being smaller than the first height;

a fuel return conduit, a first end of the fuel return conduit being fluidly connectable to the fuel tank, a second end of the fuel return conduit being fluidly connectable to the injector outlet for returning fuel from the injector outlet to the fuel tank; and a vapor return conduit, a first end of the vapor return conduit being fluidly connected to the fuel vapor separator, a second end of the vapor return conduit being fluidly connectable to the fuel tank for supplying fuel vapor from the fuel vapor separator to the fuel tank, a terminal opening at the first end of the vapor return conduit being within the fuel chamber and being located at a third height measured from the bottom surface of the fuel chamber, the third height being greater than the first height.

2. The fuel system of claim 1, further comprising a pulse pump fluidly connected to the fuel supply conduit to be operable to supply fuel from the fuel tank to the fuel chamber via the fuel supply conduit when the second end of the fuel supply conduit is fluidly connected to the fuel tank.

3. The fuel system of claim 1, wherein:

the fuel system includes the fuel tank, the second end of the fuel supply conduit is fluidly connected to the fuel tank, and the fuel tank has a pressure relief valve operable to release fuel vapor pressure in the fuel tank to ambient air when the fuel vapor pressure reaches a first predetermined pressure threshold.

4. The fuel system of claim 1, wherein:

the fuel system includes a check valve positioned in the vapor return conduit, and the check valve:

prevents fluid flow through the check valve in a fluid direction from the fuel tank toward the fuel vapor separator, prevents fluid flow through the check valve in a fluid direction from the fuel vapor separator toward the fuel tank when fluid pressure in the vapor return conduit fluidly upstream of the check valve is below a second predetermined pressure threshold, and permits fluid flow through the check valve in the fluid direction from the fuel vapor separator toward the fuel tank when fluid pressure in the vapor return conduit fluidly upstream of the check valve is above the second predetermined pressure threshold.

5. The fuel system of claim 4, wherein the vapor return conduit includes a vapor return line fluidly upstream of the check valve, the terminal opening at the first end of the vapor return conduit being in one end of the vapor return line.

6. The fuel system of claim 1, wherein the vapor return conduit and the fuel return conduit fluidly overlap at least in part.

7. The fuel system of claim 6, wherein the fuel return conduit includes a fuel return line and the vapor return conduit includes a vapor return line physically connected to the fuel return line.

8. The fuel system of claim 1, wherein the vapor return conduit includes a vapor return line, the fuel supply conduit includes a fuel line, and the vapor return line is located within the fuel line.

9. The fuel system of claim 1, wherein:

the fuel system includes a fuel filter fluidly positioned in the fuel supply conduit, the vapor return conduit includes a vapor return line, the fuel supply conduit includes a fuel line, and the vapor return line is within the fuel line at least between the fuel filter and the fuel tank.

10. A marine outboard engine, comprising:

an internal combustion engine having a crankshaft, a fuel injector, the fuel injector having an injector inlet for receiving a fuel supply and an injector outlet in fluid communication with the injector inlet for recirculating at least some of the fuel supply received by the injector inlet when the internal combustion engine operates;

a driveshaft having a first end connected to the crankshaft, and a second end opposite the first end;

a transmission connected to the second end of the driveshaft to be driven by the driveshaft;

an output shaft having a first end connected to the transmission to be selectively driven by the transmission, and a second end opposite the first end;

a rotor connected to the second end of the output shaft to driven by the output shaft for propelling the marine outboard engine;

a fuel vapor separator defining a fuel chamber, the fuel chamber being a pressurizable fuel chamber, the fuel vapor separator including an elongate body defining the pressurizable fuel chamber therein, the fuel chamber being structured to have a column of gas in a top part of the fuel chamber when the internal combustion engine operates;

a fuel supply conduit, a first end of the fuel supply conduit being fluidly connected to the fuel chamber, a second end of the fuel supply conduit being fluidly connectable to the fuel tank for supplying fuel from the fuel tank to the fuel chamber, a terminal opening at the first end of the fuel supply conduit being within the fuel chamber and being located at a first height measured from a bottom surface of the fuel chamber;

an injector conduit, a first end of the injector conduit being fluidly connected to the fuel vapor separator, a second end of the injector conduit being fluidly connected to the injector inlet for supplying fuel from the fuel vapor separator to the injector inlet, a terminal opening at the first end of the injector conduit being within the fuel chamber and being located at a second height measured from the bottom surface of the fuel chamber, the second height being smaller than the first height;

a fuel return conduit, a first end of the fuel return conduit being fluidly connectable to a fuel tank, a second end of the fuel return conduit being fluidly connected to the injector outlet for returning fuel from the injector outlet to the fuel tank; and a vapor return conduit, a first end of the vapor return conduit being fluidly connected to the fuel vapor separator, a second end of the vapor return conduit being fluidly connectable to the fuel tank for supplying fuel vapor from the fuel vapor separator to the fuel tank, a terminal opening at the first end of the vapor return conduit being within the fuel chamber and being located at a third height measured from the bottom surface of the fuel chamber, the third height being greater than the first height.

11. The marine outboard engine of claim 10, wherein:

the marine outboard engine includes a check valve positioned in the vapor return conduit, and the check valve:

prevents fluid flow through the check valve in a fluid direction from the fuel tank toward the fuel vapor separator, prevents fluid flow through the check valve in a fluid direction from the fuel vapor separator toward the fuel tank when fluid pressure in the vapor return conduit fluidly upstream of the check valve is below a second predetermined pressure threshold, and permits fluid flow through the check valve in the fluid direction from the fuel vapor separator toward the fuel tank when fluid pressure in the vapor return conduit fluidly upstream of the check valve is above the second predetermined pressure threshold.

12. The marine outboard engine of claim 10, wherein the vapor return conduit and the fuel return conduit fluidly overlap at least in part.

13. The marine outboard engine of claim 10, wherein the vapor return conduit includes a vapor return line, the fuel supply conduit includes a fuel line, and the vapor return line is located within the fuel line.

14. The marine outboard engine of claim 10, wherein the elongate body extends at least in part parallel to the driveshaft.

15. The marine outboard engine of claim 14, wherein the fuel vapor separator is positioned relative to the internal combustion engine such that when the marine outboard engine is attached to a transom of a watercraft in a body of water and is in an in-use position, at least a part of the fuel vapor separator is submerged in the body of water.

16. The marine outboard engine of claim 14, wherein the elongate body is located below the crankshaft and above the output shaft.

* * * * *